US006094769A

United States Patent [19]

Driesen et al.

[11] Patent Number: 6,094,769

[45] Date of Patent: Aug. 1, 2000

[54] BRISTLE FOR A TOOTHBRUSH

[75] Inventors: Georges Driesen, Weilrod; Ahmet Cem Firatli, Wiesbaden; Rainer Hans, Idstein; Norbert Schaefer, Frankfurt; Armin Schwarz-Hartmann, Albig, all of Germany

[73] Assignee: Braun GmbH, Frankfurt, Germany

[21] Appl. No.: 09/283,812

[22] Filed: Apr. 1, 1999

Related U.S. Application Data

[63] Continuation of application No. PCT/EP97/05222, Sep. 24, 1997.

[30] Foreign Application Priority Data

Oct. 2, 1996 [DE] Germany ..... 196 40 852

[51] Int. Cl.[7] ..... A46D 1/00; D06M 10/04; D01D 1/00

[52] U.S. Cl. ..... 15/207.2; 15/167.1; 300/21; 264/178 F; 264/177.13; 264/210.1; 264/290.5; 428/371; 428/397; 428/399; 428/400

[58] Field of Search ..... 15/207.2, 167.1, 15/159.1, 160; 300/21; 428/397, 399, 400, 371; 264/178 F, 177.13, 210.1, 290.5

[56] References Cited

U.S. PATENT DOCUMENTS

| | | | |
|---|---|---|---|
| 2,207,157 | 7/1940 | Neville et al. . | |
| 2,434,533 | 1/1948 | Wurzburger | 428/371 |
| 3,239,867 | 3/1966 | Charvat . | |
| 3,505,163 | 4/1970 | Meers et al. . | |
| 3,567,569 | 3/1971 | Terumichi et al. | 15/207.2 |
| 4,498,708 | 2/1985 | Bromboz | 300/2 |
| 4,646,381 | 3/1987 | Weihrauch | 15/167 |
| 4,762,750 | 8/1988 | Girgis et al. | 428/378 |
| 4,927,281 | 5/1990 | Gueret | 401/129 |
| 5,220,774 | 6/1993 | Harbeke et al. | 428/400 |
| 5,272,005 | 12/1993 | Collier et al. | 428/373 |
| 5,409,740 | 4/1995 | Brann | 427/513 |
| 5,533,227 | 7/1996 | Ito et al. | 15/167.1 |
| 5,687,482 | 11/1997 | Behrendt | 428/399 |
| 5,725,954 | 3/1998 | Montsinge | 428/397 |

FOREIGN PATENT DOCUMENTS

| | | | |
|---|---|---|---|
| 531551 | 10/1956 | Canada | 15/207.2 |
| 329 505 | 8/1989 | European Pat. Off. | A46D 1/00 |
| 973159 | 2/1951 | France | 428/599 |
| 1 140 901 | 9/1961 | Germany . | |
| 34 22 623 A1 | 12/1985 | Germany | A46B 9/04 |
| 195 33 815 A1 | 3/1997 | Germany | A46B 9/04 |
| 233709 | 8/1994 | Japan | 15/207.2 |
| 1 137 407 | 8/1965 | United Kingdom | A46D 1/04 |

*Primary Examiner*—Gary K. Graham
*Attorney, Agent, or Firm*—Edward S. Podszus

[57] ABSTRACT

The invention is directed to a bristle (1) for a toothbrush, in particular for an electric toothbrush, which is comprised of a monofilament (2) made of plastic. The monofilament (2) is of a non-circular cross-section, is twisted about its longitudinal axis, and is fixed as a result of the action of chemical agents. In this manner, the bristle (1) is provided with a three-dimensionally structured surface which effects an improved cleaning action, in particular with regard to the removal of plaque.

31 Claims, 2 Drawing Sheets

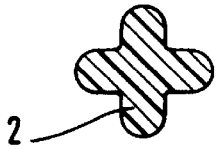
Fig.1b
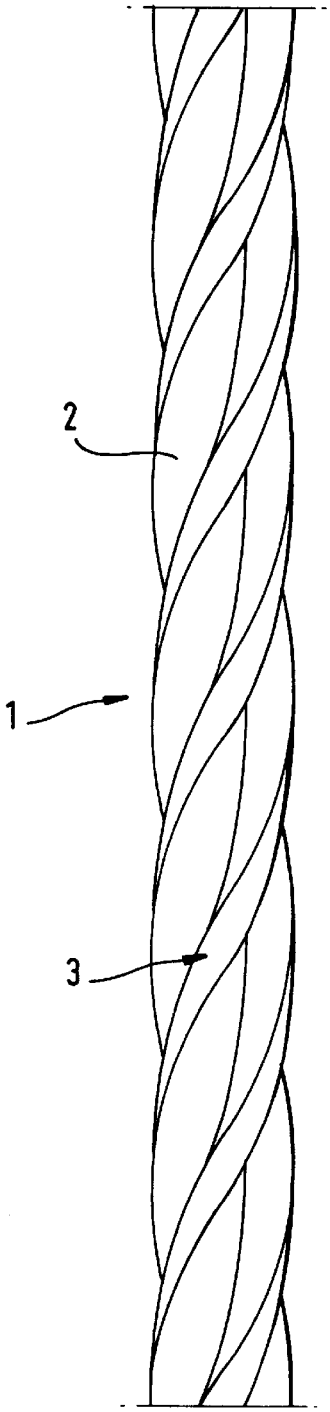
Fig.1a
Fig. 2
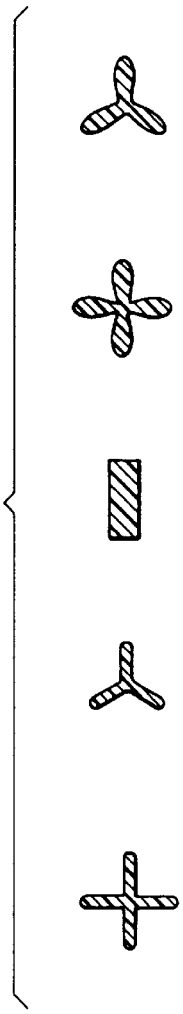

BRISTLE FOR A TOOTHBRUSH

This is a continuation of International application No. PCT/EP97/05222, pending, with an International filing date of Sep. 24, 1997.

This invention relates to a bristle for a toothbrush, in particular for an electric toothbrush, which is comprised of a monofilament made of plastic.

Bristles of this type are generally known and are used, for example, in electrically powered toothbrushes.

SUMMARY OF THE INVENTION

It is an object of the present invention to further develop such bristles, in particular with a view to achieving an improved cleaning effect when cleaning teeth.

This object is accomplished in a bristle of the type initially referred to in that the monofilament is of a non-circular cross-section, is twisted about its longitudinal axis, and is fixed as a result of the action of chemical agents.

A three-dimensionally structured surface is created by the non-circular cross-section and the twisting of the monofilament. Since an important role in dental cleaning is played not only by the bristle tip but also by the bristle shell surface, the bristle constructed in accordance with the present invention has a greater cleaning effect than hitherto. In particular, the structured surface is in a position to remove plaque from the tooth surface substantially better.

The twist and hence the structured surface of the monofilament are set permanently by fixing with the aid of chemical agents. During this process, the orientation conditions of the molecular chains in the filament material remain practically unchanged. Relocations occur in the edge layers only. This results in greater strength and rigidity of the bristle for the same diameter than with other fixing methods. As a result of the type of fixing used, it is possible to use monofilaments with particularly small diameters, which are then significantly better able to penetrate in particular interproximal spaces for the removal of plaque. The cleaning effect of the bristle according to the invention is thus substantially improved on the whole.

In an advantageous further configuration of the bristle of the present invention, the cross-section of the monofilament is approximately symmetrical to a plane extending parallel to the longitudinal axis. It has proven to be particularly suitable for the cross-section of the monofilament to be of an approximately stellate configuration. A particularly good three-dimensionally structured surface of the bristle is formed by these further configurations. In particular, this results in a helically structured bristle surface.

Diameters in the range from 0.1016 mm (4 mils), approximately, to 0.254 mm (10 mils), approximately, have proven to be particularly advantageous for the envelope curve of the monofilament, particularly in connection with the use of the bristle of the present invention in an electric toothbrush. Further, it is advantageous for the monofilament to have twists numbering from 0.5, approximately to 2 per mm, approximately, in the direction of the longitudinal axis, and for the monofilament to be made of polyamide, polyester and/or polypropylene.

In an advantageous method of manufacturing a bristle according to the present invention, the monofilament is twisted and then fixed as a result of the action of chemical agents. In this manner, the twist is retained permanently, while the mechanical properties of the monofilament are substantially preserved. Edges and corners are rounded off by the partial chemical dissolving of the monofilament, and the resulting transitions are clean particularly from the point of view of hygiene. Further, the fixing referred to represents a simple and highly controllable way of processing the twisted monofilament and of manufacturing therefrom the bristle according to the present invention with the described surface structure.

In an advantageous further configuration of the method of the present invention, the monofilament is twisted at one point, and at the same time twisting is prevented or curbed at a distance from this particular point. In this manner, a helical three-dimensional structure is produced on the surface of the bristle. Further, this structure includes additional edges and radii, which have an advantageous effect in general in dental cleaning and which are particularly suitable for removing plaque from the tooth surface or from out of interproximal spaces.

In an advantageous further configuration of the method of the present invention, the filaments are fixed in the solvent for a period of between 5 s, approximately, and 50 s, approximately, preferably between 20 s, approximately ,and 30 s, approximately. Formic acid has proven to be a particularly appropriate solvent for filaments made of polyamide.

In a particularly advantageous further configuration of the invention, the bristles of the invention are used in the inner field of a preferably electrically powered round-head toothbrush. (See FIGS. 3, 4).

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summary in the claims and their back reference.

BRIEF DESCRIPTION OF THE DRAWINGS

FIGS. 1*a* and 1*b* are a schematic view and a cross-sectional view of a toothbrush bristle, illustrating an embodiment of the present invention;

FIG. 2 is a schematic view of alternative cross-sections of the bristle of FIG. 1;

DETAILED DESCRIPTION OF PREFERRED EMBODIMENTS

Figure 3:
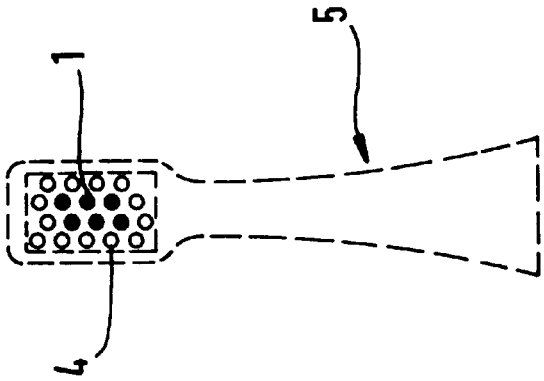
FIG. 3 is a schematic view of a field of bristles of FIG. 1 on a toothbrush head.

FIGS. 1*a* and 1*b* show a bristle 1 which comprises monofilament 2. The monofilament 2 is made of plastic and is twisted. The twist is executed uniformly, which means that the surface structure of the bristle 1 is repeated continuously. The bristle 1 thus has a structured surface which the monofilament 2 does not possess initially, but which is not created until the monofilament 2 is twisted.

The monofilament 2 shown in FIGS. 1*a* and 1*b* may be made of polyamide, polyester, or polypropylene. The diameter of the envelope curve of the monofilament 2 referred to may amount to between 0.1016 mm (4 mils), approximately, and 0.254 mm (10 mils), approximately. The monofilament 2 may have twists numbering from 0.5 per mm, approximately, to 2.0 per mm, approximately, in the direction of its longitudinal axis.

The monofilament 2 has a non-circular cross-section. This cross-section is of a stellate configuration in accordance with FIG. 1*b* and hence is approximately symmetrical to a plane extending parallel to the longitudinal axis. A helical three-dimensional structure, identified by reference numeral 3 in FIG. 1*a*, is obtained by the non-circular cross-section and the twisting of the monofilament 2.

It is also possible for the cross-section of the monofilament 2 to adopt any one of the alternative shapes as illustrated in FIG. 2.

To manufacture the bristle 1, the monofilament 2 is twisted. For this purpose, the monofilament 2 is twisted at one point while at the same time it is held fixed at a distance from this particular point, thus preventing or at least curbing a twist. It is possible to perform the twisting of the monofilament 2 with prior stretched filaments which already have the required mechanical properties.

The twisted monofilament 2 is then dipped in a solvent where it is fixed by partial chemical dissolving. The dwell time in the solvent amounts to a period of between 5 s, approximately, and 50 s, approximately. Phenol, M-cresol or formic acid may be used as solvents. Highly concentrated formic acid has proven to be particularly advantageous. In this case the monofilament is conveniently wetted with the solvent for a period of between 20 s, approximately, and 30 s, approximately. By dipping or wetting the monofilament 2 in or with the solvent, the twisting is fixed. This means that the monofilament 2 does not untwist again but that the twist remains permanently.

During or after the fixing it is possible to vary the mechanical properties, in particular the rigidity, the fatigue and/or the resilience of the monofilament 2, by stretching and/or by means of a thermal treatment.

The monofilament 2 is then cleaned of the solvent by rinsing with water or the like, or the solvent is neutralized by some other means, for example, by evaporation. The monofilament 2 is then dried by radiated heat or the like.

Figure 4:
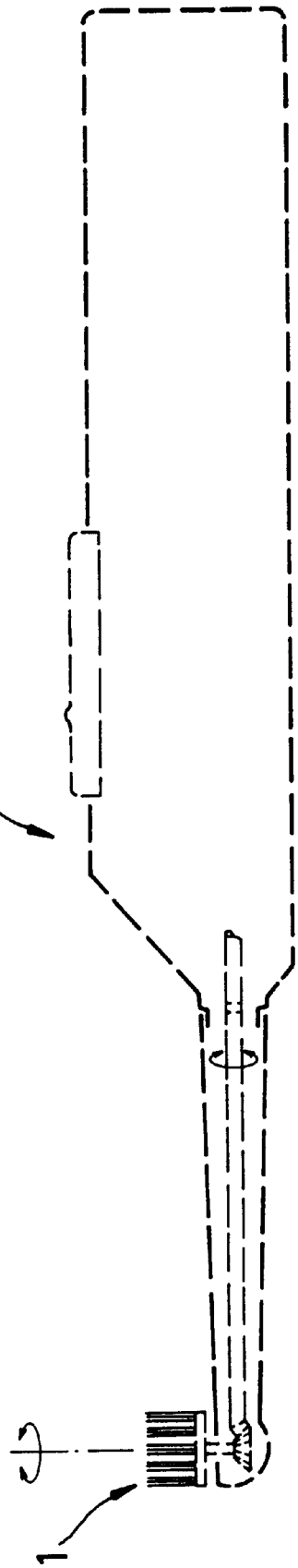
FIG. 4 is a schematic view of a field of bristles of FIG. 1 on a rotary bristle head.

The described bristle 1 of FIGS. 1*a* and 1*b* is intended for use, as illustrated in FIG. 3 and FIG. 4, in toothbrushes 5, particularly for use in electric toothbrushes 6. FIG. 3 shows a field 4 of bristles on the toothbrushe's bristle head. The described bristle 1 may be used particularly advantageously in the inner field of a round-head tooth brush.

What is claimed is:

1. A toothbrush bristle comprising a plastic monofilament, said monofilament having a longitudinal axis, a non-circular cross-section transverse said longitudinal axis, an initial molecular structure having initial mechanical properties, and defining a core region and a peripheral region of the cross-section remote in a radial direction from said longitudinal axis, said monofilament being twisted about its longitudinal axis such that the peripheral region has a helically shaped surface, and said peripheral region being at least partially dissolved by a solvent while said core region being substantially not dissolved by said solvent, whereby said solvent-treated peripheral region has a different molecular structure than said core region and whereby said solvent-untreated core region has substantially said initial molecular structure and mechanical properties, whereby said bristle permanently retains the helically shaped surface.

2. A toothbrush bristle according to claim 1, wherein the cross-section of the monofilament is approximately symmetric about a plane parallel the longitudinal axis.

3. A toothbrush bristle according to claim 1, wherein the cross-section of the monofilament has an approximately stellate shape.

4. A toothbrush bristle according to claim 1, wherein an imaginary envelope surface about the monofilament has a diameter of between about 0.1016 mm and about 0.254 mm.

5. A toothbrush bristle according to claim 1, wherein the helically shaped surface has a pitch of between about 2 mm and about 0.5 mm.

6. A toothbrush bristle according to claim 1, wherein the monofilament comprises a plastic selected from a group of plastics consisting of polyamide, polyester and polypropylene.

7. A toothbrush bristle according to claim 1, wherein the core regions is centrally disposed within an imaginary envelope surface about the monofilament.

8. A toothbrush bristle according to claim 1, wherein the helically shaped surface has uniformly shaped twists.

9. A toothbrush bristle according to claim 1, wherein the solvent is selected from a group of solvents consisting of phenol, M-cresol and formic acid.

10. A plurality of toothbrush bristles according to claim 1 in combination with a toothbrush having a bristle head on which is disposed a field of bristles.

11. The plurality of bristles according to claim 10 in combination with the toothbrush, said plurality of bristles being disposed in an inner field of the toothbrush head.

12. The plurality of toothbrush bristles according to claim 10 in combination with the toothbrush, said toothbrush being electrically powered and having a rotary bristle head.

13. A toothbrush bristle according to claim 1, wherein said solvent-treated peripheral region has rounded-off edges along the helical surface.

14. A toothbrush bristle according to claim 1, wherein an imaginary envelope surface about the monofilament has a diameter of not more than about 0.254 mm (10 mils).

15. A toothbrush bristle according to claim 1, wherein the monofilament is further stretched so as to have throughout the cross-section thereof resultant mechanical properties altered from the initial mechanical properties.

16. A toothbrush bristle according to claim 1, wherein the monofilament is further thermally treated so as to have throughout the cross-section thereof resultant mechanical properties altered from the initial mechanical properties.

17. A method of producing a toothbrush bristle comprising the steps of providing a plastic monofilament having a longitudinal axis and a peripheral region remote in a radial direction from said longitudinal axis, twisting the monofilament about its longitudinal axis to impart a helically shaped surface to the peripheral region, contacting the peripheral region with a solvent, dissolving at least partially the peripheral region, and thereby permanently fixing the helically shaped surface of the bristle.

18. A method of producing a toothbrush bristle according to claim 17, wherein the step of providing further comprises providing the monofilament with a non-circular cross-section transverse said longitudinal axis.

19. A method of producing a toothbrush bristle according to claim 17, wherein the step of twisting further comprises simultaneously retarding, at a location along the longitudinal axis remote from application of said twisting, the monofilament against twisting.

20. A method of producing a toothbrush bristle according to claim 17, wherein the step of contacting is performed for a time between about 5 sec and about 50 sec.

21. A method of producing a toothbrush bristle according to claim 20, wherein the time is between about 20 sec and about 30 sec.

22. A method of producing a toothbrush bristle according to claim 12, wherein the step of contacting further comprises using the solvent selected from a group of solvents consisting of phenol, M-cresol and formic acid.

23. The toothbrush bristle made in accordance with the process of claim 17.

24. A method of producing a toothbrush bristle according to claim 17, further comprising the step of stretching, prior to said step of twisting, the monofilament so as to alter mechanical properties thereof.

25. A method of producing a toothbrush bristle according to claim 17, further comprising the step of stretching, subsequent to said step of twisting, the monofilament so as to alter mechanical properties thereof.

26. A method of producing a toothbrush bristle according to claim 17, further comprising the step of neutralizing the solvent.

27. A method of producing a toothbrush bristle according to claim 17, further comprising the step of heating, prior to completing said fixing, the monofilament so as to alter mechanical properties thereof.

28. A method of producing a toothbrush bristle according to claim 17, further comprising the step of heating, subsequent to said fixing, the monofilament so as to alter mechanical properties thereof.

29. A toothbrush bristle comprising a plastic monofilament, said monofilament having a longitudinal axis, a non-circular cross-section transverse said longitudinal axis, and defining a core region and a peripheral region of the cross-section remote in a radial direction from said longitudinal axis, said monofilament being twisted about its longitudinal axis such that the peripheral region has a helically shaped surface having a pitch of between about 2 mm and about 0.5 mm, and said peripheral region being treated, whereby said treated peripheral region has a different molecular structure than said core region, whereby said bristle permanently retains the helically shaped surface.

30. A toothbrush bristle according to claim 29, wherein said treated peripheral region has rounded-off edges along the helical surface.

31. A toothbrush bristle according to claim 29, wherein an imaginary envelope surface about the monofilament has a diameter of not more than about 0.254 mm (10 mils).

* * * * *

UNITED STATES PATENT AND TRADEMARK OFFICE

CERTIFICATE OF CORRECTION

PATENT NO. : 6,094,769
DATED : August 1, 2000
INVENTOR(S) : Georges Driesen et al.

It is certified that error appears in the above-identified patent and that said Letters Patent is hereby corrected as shown below:

Column 4,
Line 15, change "regions" to -- region --;

Column 5,
Line 5, change "claim 12" to -- claim 17 --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*